United States Patent [19]

Ohno

[11] 4,209,947

[45] Jul. 1, 1980

[54] GRINDING METHOD AND APPARATUS

[76] Inventor: Tetatsu Ohno, 1-2, 1-chome, Kasuya, Setagaya-ku, Tokyo, Japan

[21] Appl. No.: 964,656

[22] Filed: Nov. 29, 1978

Related U.S. Application Data

[63] Continuation of Ser. No. 813,978, Jul. 8, 1977, abandoned.

[30] Foreign Application Priority Data

Jul. 13, 1976 [JP] Japan ..... 51-83102

[51] Int. Cl.[2] ..... B24B 31/00

[52] U.S. Cl. ..... 51/7; 51/317

[58] Field of Search ..... 51/6, 7, 17, 19, 317, 51/318, 419; 104/93, 121; 105/150

[56] References Cited

U.S. PATENT DOCUMENTS

| | | | |
|---|---|---|---|
| 2,749,669 | 6/1956 | Sleeper | 51/7 |
| 2,899,777 | 8/1959 | Davidson | 51/7 |
| 2,921,412 | 1/1960 | Kay | 51/7 |
| 2,921,413 | 1/1960 | Kay | 51/7 |
| 3,516,203 | 6/1970 | Hambright | 51/19 X |
| 3,603,037 | 9/1971 | Mann | 51/418 X |

FOREIGN PATENT DOCUMENTS

| | | | |
|---|---|---|---|
| 533471 | 5/1975 | U.S.S.R. | 51/7 |

*Primary Examiner*—Gary L. Smith
*Attorney, Agent, or Firm*—Laurence R. Brown

[57] ABSTRACT

A grinding method wherein a work is moved along a grinding tank and on the surface of or in the interior of a grinding material, as required, while being rotated within the large grinding tank charged with the grinding material and a grinding apparatus comprising a large grinding tank charged with a grinding material a guide rail provided above and along said grinding tank, a main shaft rotating head moving along said guide rail and a chuck securing a work to the lower end of said head, whereby the work is moved in contact with the grinding material, as required, while being rotated. With these method and apparatus, it is possible to grind even a large work over the entire surface.

3 Claims, 5 Drawing Figures

GRINDING METHOD AND APPARATUS

This is a continuation of application Ser. No. 813,978, filed July 8, 1977, now abandoned.

BACKGROUND OF THE INVENTION

1. Field of the Invention

This invention relates to a vertical grinding apparatus, that is, a grinding method and apparatus wherein a large grinding tank is charged with a proper grinding material and, on the other hand, a work is moved along the grinding tank and on the surface of or in the interior of the grinding material while being held by a chuck provided on a main shaft spindle so as to be in contact on the entire surface with the grinding material.

2. Description of the Prior Art

In the already known rotary barrel grinder, generally the barrel is charged with many works, a grinding material and others and is rotated so that the contents in said barrel may flow and move and the works may be ground by the mutual friction of the works with the grinding material. However, in such method, there have been defects that a long time is required to finish the works and that the works slide with each other to produce striking traces.

SUMMARY OF THE INVENTION

The present invention is to eliminate such conventional defects and is to make it possible to grind large works, to reduce the finishing time, to obtain a strength finish uniform in the grinding and very high in the precision and to improve the grinding effect.

A primary object of the present invention is to provide a grinding method wherein a work is moved along a grinding tank and on the surface of or in the interior of a grinding material within the large grinding tank charged with the grinding material.

Another object of the present invention is to provide a grinding apparatus to be directly used to work the above mentioned grinding method, comprising a large grinding tank charged with a grinding material, a guide rail provided above and along said grinding tank, a main shaft head moving along said guide rail and a chuck securing a work to the lower end of said head so that the work may be moved on the surface of or in the interior of the grinding material with which the grinding tank is charged.

DETAILED DESCRIPTION OF PREFERRED EMBODIMENT

Figure 1:
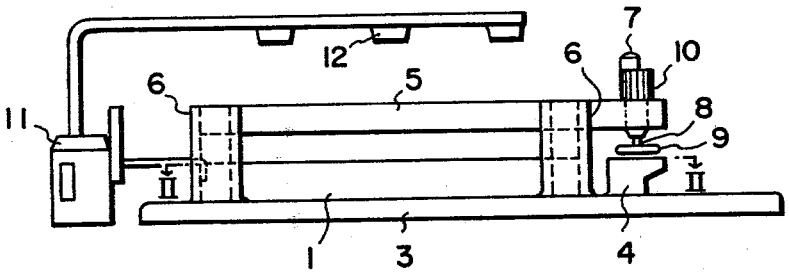
FIG. 1 is an elevation showing a grinding apparatus embodying the present invention.
Figure 2:
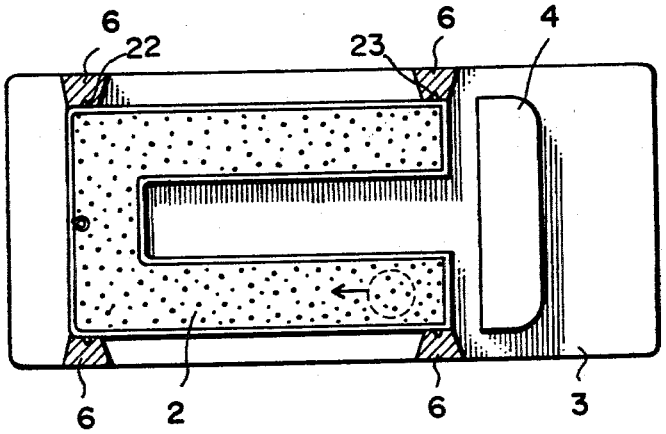
FIG. 2 is a sectioned view on line II—II in FIG. 1.

The present invention shall be explained in the following with reference to the drawings. In FIGS. 1 and 2, 1 is a large U-shaped grinding tank charged with a proper grinding material 2 and having outward of one end a chucking table 4 arranged on a body bed 3. 5 is a guide rail supported above the grinding tank 1 with stays 6, provided along the grinding tank 1 and extended at the ends to above the chunking table 4 to be jointed in the form of a ring. 7 is a main shaft head provided with a chuck 8*a* at the tip of its shaft 8 so as to suspend a work 9, for example, with a collet chuck or vacuum attraction, to rotate it with an electric motor 10 or to keep it stationary. The main shaft head 7 and a motor 10 itself are moved integrally along the guide rail 5 by such feeding means as, for example, a chain or gear. The shaft 8 is operated by a controlling means so as to move vertically. 11 is a grinding material discharging means. 12 is a grinding material supplying means.

Figure 3:
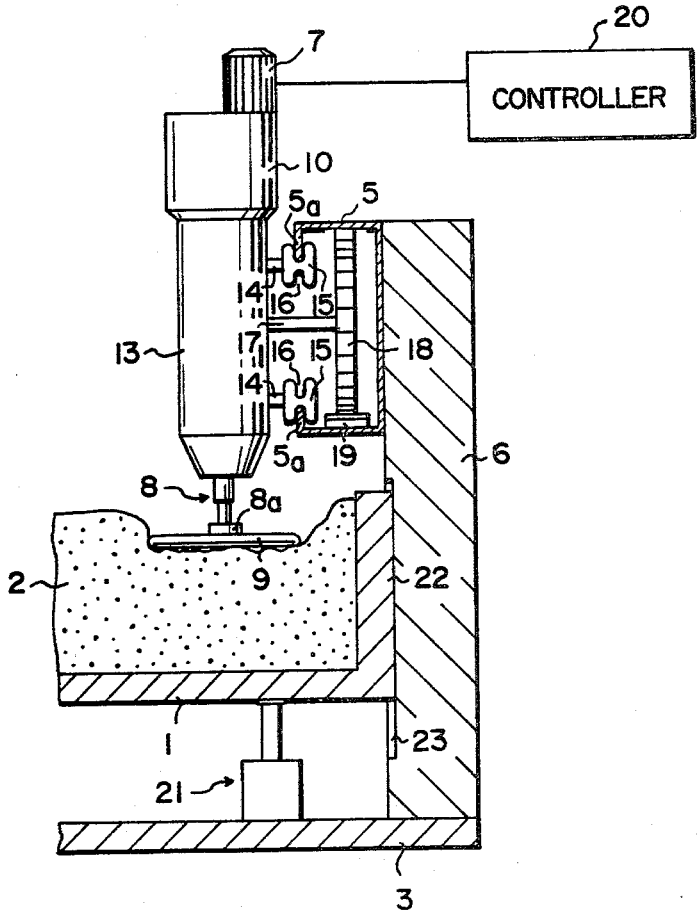
FIG. 3 is a magnified sectioned side view showing in detail a feeding means and vertically moving mechanism of the present invention.

The details of the above described feeding means and vertically moving means are shown in FIG. 3.

The rail s supported with the stays 6 is C-shaped in the cross-section. The middle grooves 16 of respective rollers 15 rotatably fitted to a pair of shafts projecting horizontally out of a cylinder body 13 are fitted respectively to both free edge parts 5*a* of the rail 5. On the other hand, a driving shaft 17 driven by an electric motor or any other driving source projects also horizontally out of the cylinder body 13 and is fitted at one end with a gear 18 meshing with rack 19 provided within the rail 5 to move the shaft 8. A controller 20 is connected with the main shaft head 7 so as to vertically move the shaft 8.

Instead of vertically moving the shaft 8, an oil pressure unit 21 for vertically moving the grinding tank 1 may be provided. In such case, if a vertical projection 22 is provided on the outside surface of the grinding tank 1, a vertical groove 23 is provided in a corresponding position on each stay 6 and the projection and groove are fitted with each other to guide the vertical motion of the grinding tank, they will serve as safe guides.

Further, as required, it is possible to use both controller 20 and oil pressure unit 21.

Figure 4:
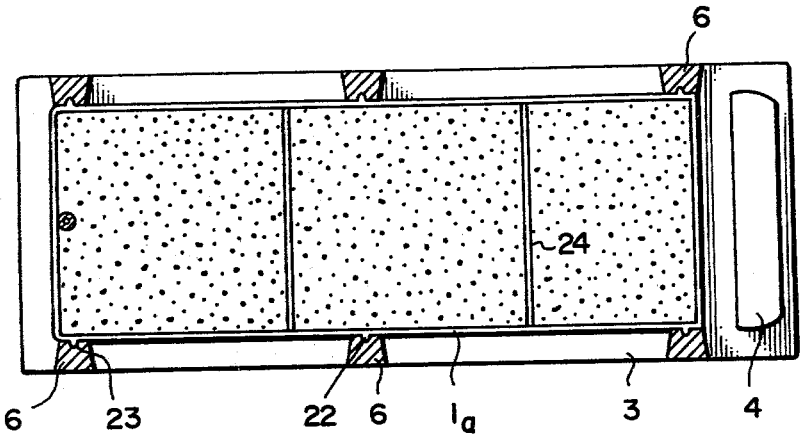
FIG. 4 is the same view as FIG. 2 of another embodiment of the present invention.
Figure 5:
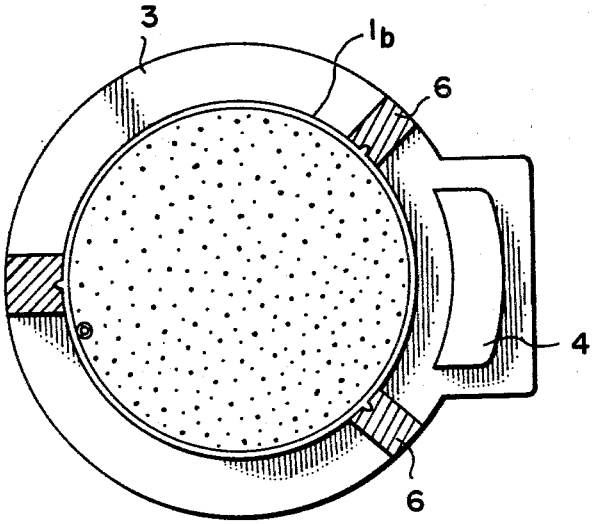
FIG. 5 is the same view as FIG. 2 of still another embodiment of the present invention.

In the above mentioned embodiment, the main shaft head 7 is first moved to attract the work 9 located on the chucking table 4 to the chuck 8*a* and the work 9 is then moved to above the grinding tank 1 along the guide rail 5 by the feeding means while being suspended above. The work 9 is moved downward by the controller 20 while being stopped or rotated above the grinding tank or the grinding tank 1 is moved upward by the oil pressure unit 21 so that the work 9 may contact the grinding material. As the work 9 moves in contact with the grinding material along the guide rail 5 while stopping or rotating on the surface of or in the interior of the grinding material 2, the work will be ground over the entire surface. Needless to say, though the grinding efficiency and finished state are different depending on the rotating speed of the work 9, the kind of the grinding material and the moving speed of the work, the work will be ground very easily and at a high efficiency. In case the work is thin or fine, if the shaft is rotated, the work will be deformed. Therefore, the shaft had better be left stopped in such case. By the way, the guide rail 5 may be moved vertically as a guide. The grinding tank 1 is U-shaped in FIG. 1 but may be linear as in FIG. 4. Further, if the grinding tank 1*a* is sectioned with partition plates 24 so that the grinding materials may be respectively for coarse, medium and lustrous finishes, the work will be able to be ground at once to the lustrous finish. It is also possible to make the grinding tank 1*b* circular as in FIG. 5. If many main shaft heads 7 are set along the guide rail 5 instead of one, the grinding efficiency will further improve and it will be possible to make a continuous automated grinding or manless grinding.

As explained above, according to the present invention, as a work is moved while in contact with a grinding material with which a grinding tank is charged, it is possible to grind a large work over the entire surface, the grinding efficiency is very high and the invertion is very effective to the automation of the grinding.

What I claim is:

1. Grinding apparatus wherein a workpiece follows a path in a longitudinally shaped grinding tank defined by a guide rail positioned alongside the tank, comprising in combination, a working piece to be ground, a longidutinally shaped grinding tank having a path defined therein for moving said working piece along the grinding tank, a charge of grinding material located in said path for contact with said working piece, a guide rail provided alongside said grinding tank path, work control means movable along said guide rail for moving the workpiece along the path, a rotatable chuck movable with said control means having means securing the workpiece to its lower end, means for rotating the chuck and the workpiece as the workpiece is moved along the path in said grinding material, vertically moving means for relatively moving the chuck holding the workpiece vertically relative to the guide rail to contact the grinding material in the tank path operable while the workpiece is being rotated, a driving shaft and gear projecting from said chuck together with a rack on the guide rail meshing with said gear for moving the work control means along said rail, guide rail structure presenting a C-shaped cross-section alongside said chuck with a free edge at each cross-sectional end, and a pair of rollers with grooves therein each rotatably fitted to said chuck and rollably engaging with its respective groove a respective one of the free edges of the guide rail as the chuck moves about said path.

2. The grinding apparatus according to claim 1 wherein said vertically moving means further comprises a vertical guide comprising at least one stay having a vertical groove therein, and a projection provided in a corresponding position on the outside surface of the grinding tank and matingly fitting in said groove for sliding movement therein for guiding the vertical movement of the grinding tank.

3. The grinding apparatus according to claim 1 wherein said vertically moving means comprises an oil pressure means provided on the bottom surface of the grinding tank to move the tank vertically.

* * * * *